US007743456B2

(12) United States Patent
McDonnell

(10) Patent No.: US 7,743,456 B2
(45) Date of Patent: Jun. 29, 2010

(54) MICROFIBER COVER FOR CLEANING TOOL

(75) Inventor: Joseph A. McDonnell, Weston, FL (US)

(73) Assignee: For Life Products, Inc., Sunrise, FL (US)

( * ) Notice: Subject to any disclaimer, the term of this patent is extended or adjusted under 35 U.S.C. 154(b) by 1039 days.

(21) Appl. No.: 11/077,144

(22) Filed: Mar. 11, 2005

(65) Prior Publication Data

US 2006/0200933 A1 Sep. 14, 2006

(51) Int. Cl.
*A47L 13/44* (2006.01)

(52) U.S. Cl. ..... 15/247; 15/229.4; 15/228

(58) Field of Classification Search ..... 15/247, 15/229.4, 229.8, 228
See application file for complete search history.

(56) References Cited

U.S. PATENT DOCUMENTS 4,441,228 A 4/1984 Marquart et al.
4,945,599 A * 8/1990 Flynn ..... 15/244.3
5,292,582 A 3/1994 Gibbs et al.
5,461,749 A 10/1995 Ahlberg et al.
5,887,311 A 3/1999 Kresse et al.
6,258,455 B1 7/2001 Clarke
6,503,491 B2 1/2003 Guenin et al.
6,849,329 B2 2/2005 Perez et al.
7,150,063 B1 * 12/2006 Graham ..... 15/160
2003/0019065 A1 1/2003 Smith et al.
2003/0074756 A1 4/2003 Policicchio et al.
2003/0121116 A1 * 7/2003 Keck et al. ..... 15/104.94
2005/0273958 A1 * 12/2005 Dillon ..... 15/104.93
2007/0061987 A1 * 3/2007 Kresse et al. ..... 15/228

* cited by examiner

*Primary Examiner*—Shay L Karls
(74) *Attorney, Agent, or Firm*—Manelli Denison & Selter PLLC; Edward J. Stemberger

(57) ABSTRACT

A cleaning tool cover configured for removable application to a cleaning tool in order to provide a microfiber cleaning surface on the cleaning tool. The cleaning tool may include, for example, a sponge mop or a dust mop and the cleaning tool cover may be used wet or dry and may be attached to the cleaning tool using a variety of attachment structures. In one embodiment, the cleaning tool cover is configured as a bonnet having a recess and an elastic opening that may be enlarged temporarily to allow a mop head to be inserted into the recess and then allowed to retract to secure the cleaning tool cover to the mop. In another embodiment, the cleaning tool cover may include a plurality of flaps for attaching the tool cover to the cleaning tool.

6 Claims, 6 Drawing Sheets

MICROFIBER COVER FOR CLEANING TOOL

BACKGROUND OF THE INVENTION

This invention relates generally to cleaning tools, such as mops and brooms, particularly including sponge mops, and more particularly, to an adapter for modifying the performance of an existing cleaning tool to provide a microfiber cleaning surface.

Cleaning tools such as sponge mops are widely used in a few basic configurations, but generally include an elongated handle, a frame and a sponge portion. When used wet, the sponge portion is typically compressed in some manner for removing unwanted fluid before and during use of the sponge mop. A basic sponge mop 10 is illustrated in FIGS. 1A-C, which illustrate bottom (FIG. 1A), side (FIG. 1B) and top surface (FIG. 1C) views respectively. The basic components of the sponge mop include the sponge portion 100, a frame 102 for holding and reinforcing the sponge portion, and a handle portion 104.

As illustrated in FIGS. 2A-C, the mop handle 104 may be connected to the frame 102 in a variety of ways to provide a generally fixed angular relationship, FIG. 2A, to provide for some range of pivotal movement, FIG. 2B, about a single axis generally parallel to a longitudinal axis of the surface portion 100, or to provide for some range of rotational movement about a point, FIG. 2C, through a ball-and-socket or other suitable connection. Those of ordinary skill in the art will appreciate that most sponge mops will also incorporate one of a wide variety of lever, rolling and/or hinge mechanisms (not illustrated) for compressing at least a portion the sponge portion 102 to some degree to assist in the removal of excess liquid.

Dust mops (not illustrated) are similar in some respects, but tend to be used dry and therefore tend to lack the mechanisms associated with sponge mops for compressing the mop head. Conventional dust mops utilize a cotton fiber head having loops or lengths of cotton and/or synthetic fibers or yarns extending from a fabric cover that is attached to a wire frame that is, in turn, attached to an elongated handle. While the conventional cotton fiber heads may do an adequate job of picking up dust and dirt on a floor, their performance may be enhanced by spraying the head with chemicals to increase the basic cotton fiber head's dust pickup capability. Although typical wire frames are not precisely manufactured components, the length and variable orientation of the cotton loops or yarns provided on the duster heads tend to act as cushions compensating for any non-planar condition of the frame or other support structure to maintain contact with the floor. In addition, if the floor surface is not planar, the cushioning effect of the cotton fiber head will tend to allow the mop head to maintain ample contact with the floor and thereby attract dirt, dust and other relatively small surface contaminants.

SUMMARY OF THE INVENTION

Provided is a cleaning tool cover configured for attachment to a conventional sponge mop or dust mop to provide a microfiber cleaning surface. Apart from the microfiber cleaning surface, the cover may include other fabrics, attachment structures and reinforcing structures to improve its utility.

DESCRIPTION OF THE DRAWINGS

The invention will become more apparent by describing in detail exemplary embodiments thereof with reference to the attached drawings in which.

Figure 1A:
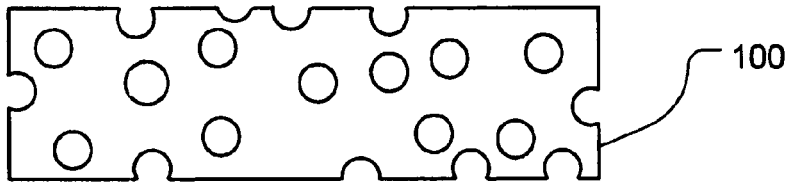
FIGS. 1A-C illustrate bottom, side and top views respectively of a conventional sponge mop.
Figure 1B:
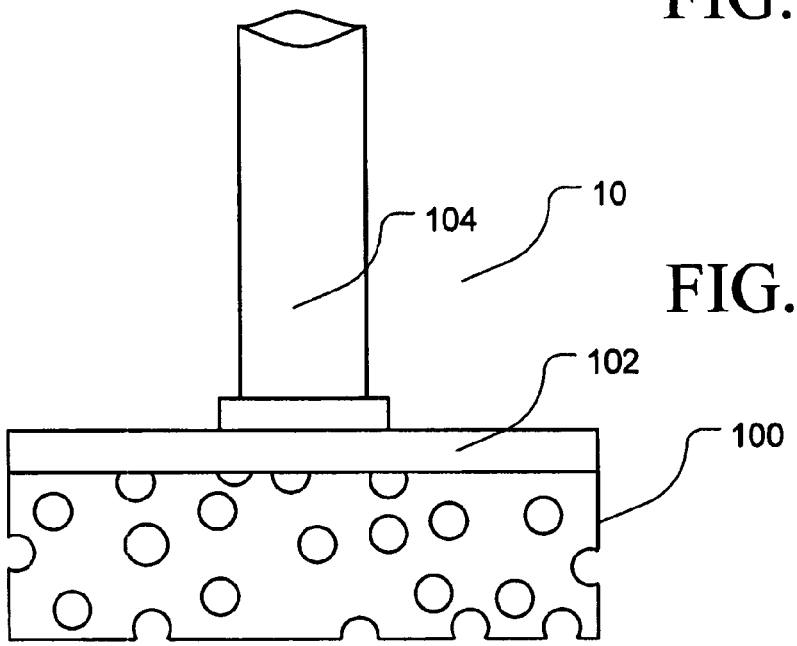
Figure 1C:
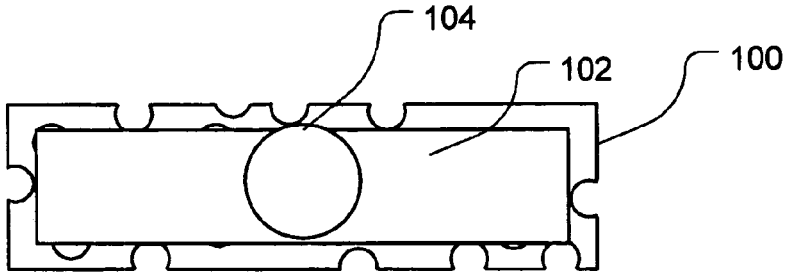
Figure 2A:
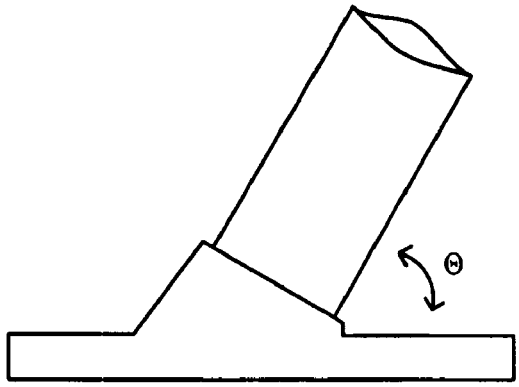
FIGS. 2A-C illustrate various attachments between the mop handle and the mop frame.
Figure 2B:
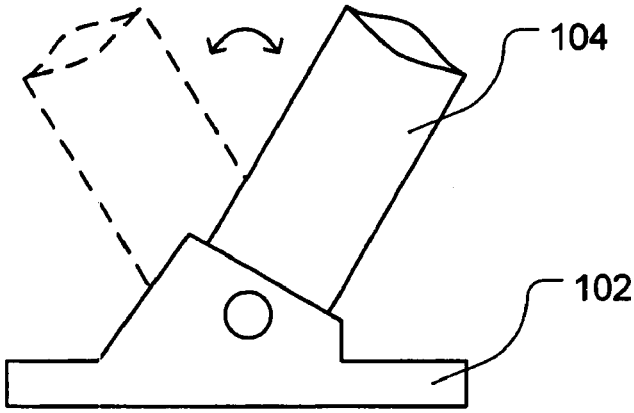
Figure 2C:
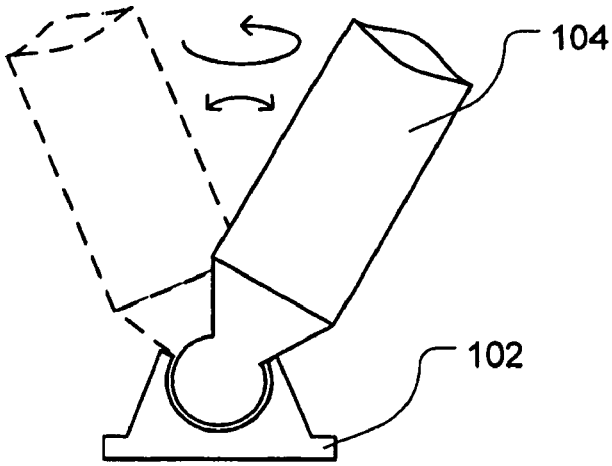

These drawings have been provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity.

Those of ordinary skill in the art will also appreciate that a range of alternative configurations have been omitted simply to improve the clarity and reduce the number of drawings. Those of ordinary skill will appreciate that certain of the various process steps illustrated or described with respect to the exemplary embodiments may be selectively and independently combined to create other methods useful for manufacturing covers for cleaning tools without departing from the scope and spirit of this disclosure.

DESCRIPTION OF EXEMPLARY EMBODIMENTS

Microfibers are very fine fibers to more conventional fiber forms with their small size resulting in unique and desirable properties relative to conventional fibers, whether natural or synthetic. Microfibers are typically about half the diameter of a fine silk fiber, about one-third the diameter of a cotton fiber, about one-quarter the diameter of fine wool, and one hundred times finer than human hair. "Denier" is the term used to define the diameter or fineness of a continuous or filament fiber such as silk or man-made fibers and refers to the weight, in grams, of a 9000-meter length of fiber or yarn. The higher the number, the thicker and/or denser the fiber.

In order to be classified as a "microfiber," the fiber must have a denier value of less than 1. While fine silk, for example, will be about 1.25 denier, many microfibers are between 0.5 to 0.6 denier. When individual fibers are combined to form a yarn, the denier increases accordingly. Very fine nylon yarns, for example, may be about 10 to 15 denier yarns and include 3 or 4 individual nylon filaments. A similar sized yarn made from microfibers, however, may include as many as 30 filaments.

When so many fine fibers are packed together they tend to provide a depth and a body to fabrics manufactured from microfiber yarns. Within the yarns, the many tiny filaments or fibers can slide back and forth and move relative to one another more easily that in conventional yarns, thereby allowing the resulting fabrics to flow and drape more freely while still providing a sufficiently durable fabric.

The first fabric made from microfiber was ULTRASUEDE™ in which short polyester microfibers were imbedded into a urethane base. Synthetic fibers are typically manufactured by a liquid through tiny holes in a device called a spinneret. By using a spinneret with sufficiently small holes or pores, most synthetic fibers may be manufactured as a microfiber. Most microfibers are manufactured from polyesters and nylons although some rayons and acrylics are also available.

Microfibers may be used alone or blended with more conventional denier man-made fibers as well as with natural fibers such as cotton, wool, and silk.

Microfibers from different manufacturers are marketed under a number of trade names including, for example, FINESSE (polyester), MICROSPUN (polyester), MICROMATTIQUE (polyester), MICROFIBER (nylon), MICRO (nylon), SILKY TOUCH (nylon), and MICROSUPREME (acrylic). Similarly, microfiber fabrics are marketed under a number of trade names including, for example, LOGANTEX, CHARISMA, ULTIMA, MOONSTRUCK, MICROMIST, REGAL, SILKMORE, STANZA, and VANESSA.

Microfibers may also be split during manufacturing to increase the effective surface area of the microfibers and make them more effective for mopping. The small splits, cracks and/or hooks formed on the surface of the microfibers render them very absorbent, thereby allowing the fabric to hold sufficient water, up to about seven times their weight in water, for cleaning without dripping. As a result, the microfiber fabric does not need to be rewetted as frequently and tends to leave the floor damp rather than wet for quicker drying. These properties will also tend to reduce the amount of water, cleanser and/or disinfectant, thereby reducing the potential for fatigue, back pain, neck strain, and other upper body injuries.

When used dry, microfiber fabrics tend to have a positive charge that tends to attract and retain dust and small particles, thereby decreasing or eliminating the need for the application of the chemical attractants commonly used with conventional dust mops.

With conventional loop mops, the soiled mop head is repeatedly rinsed in the cleaning solution which, in turn, requires frequent cleaning solution changes to prevent cross-contamination. By using a series of microfiber mop covers, only clean covers are exposed to the original cleaning solution with soiled covers set aside for cleaning, thereby reducing the need to replace the cleaning solution and reducing the amount of water and disinfectant used and disposed down the drain.

Figure 3A:
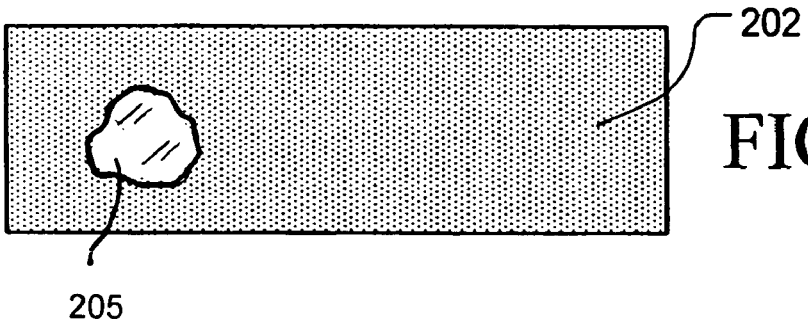
FIGS. 3A-C illustrate an embodiment of the invention.
Figure 3B:
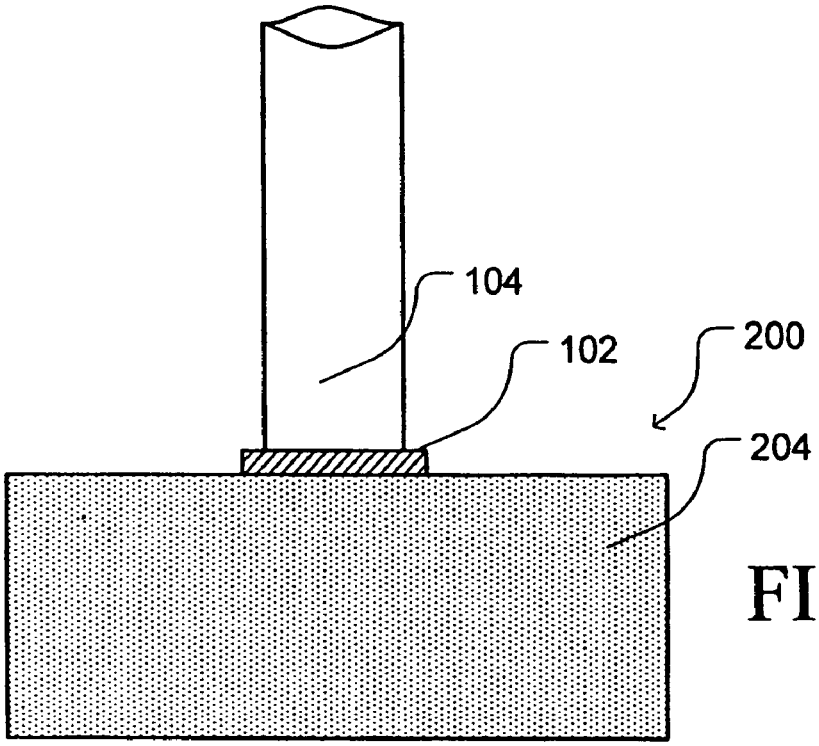
Figure 3C:
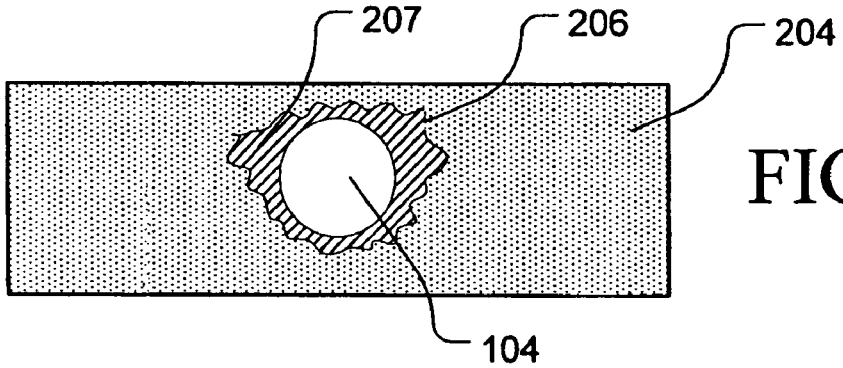

A first exemplary embodiment of the invention is illustrated in FIGS. 3A-C which correspond to bottom, side and top views respectively. As illustrated in FIG. 3A, the cleaning tool cover 200 includes a primary microfiber surface 202 that extends across the original cleaning surface of the cleaning tool 10. As illustrated in FIG. 3B, a skirt portion or portions 204 formed from microfiber, another fabric and/or mesh extend from the periphery of the primary microfiber surface to form a recess that can envelop a substantial portion of the head of the cleaning tool. The primary microfiber surface and the skirt region(s) may be provided with a water repellant or water proof backing layer 205 (a portion of which is shown in FIG. 3A) or treatment to allow for "wet" use of the microfiber surface without soaking the head of the cleaning tool or allowing contamination from a used cleaning tool to reach the external primary microfiber surface.

As illustrated in FIG. 3C, the edge of the skirt 206 is provided with or configured to be elastic to define an opening 207 into the recess. As the cleaning tool cover 200 is applied to the cleaning tool, the opening 207 can be temporarily enlarged to allow the insertion of the head of the cleaning tool, after which the opening will tend to contract, thereby securing the cleaning tool cover on the cleaning tool head. Depending on the sizing and the strength of the elastic or resilient materials used around the opening, as the opening contracts it may tend to position the primary microfiber surface 202 firmly against the lower surface of the cleaning tool head.

Figure 4A:
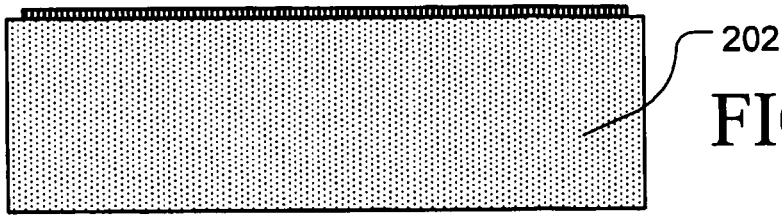
FIGS. 4A-C illustrate another embodiment of the invention.
Figure 4B:
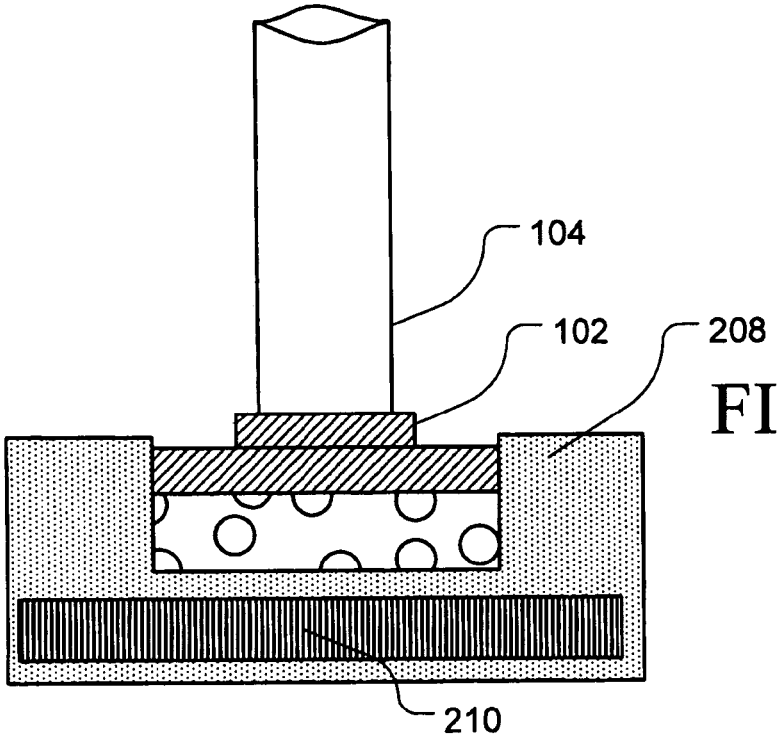
Figure 4C:
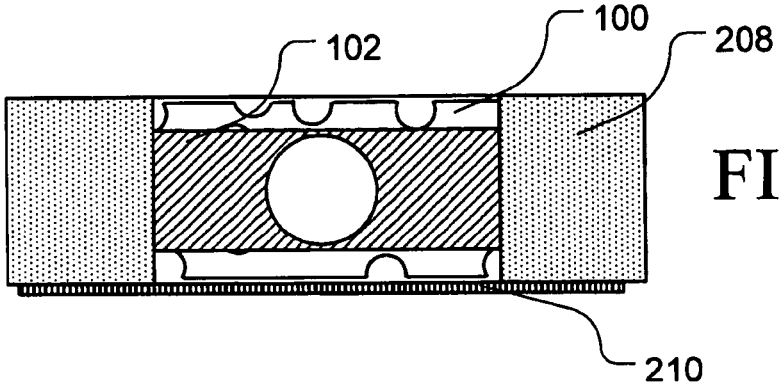

Another exemplary embodiment of the invention is illustrated in FIGS. 4A-C. As illustrated in FIG. 4A, the cleaning tool cover 200 includes a primary microfiber surface 202 that extends across the original cleaning surface of the cleaning tool 10. As illustrated in FIG. 4B, the cleaning tool cover includes a pair of pocket portions 208 or recessed for receiving opposite ends of the cleaning tool head. As illustrated in FIG. 4C, the cleaning tool cover may include an abbreviated skirt portion 204*a* on which a more abrasive region 210 may be provided for enhanced scrubbing ability.

Figure 5A:
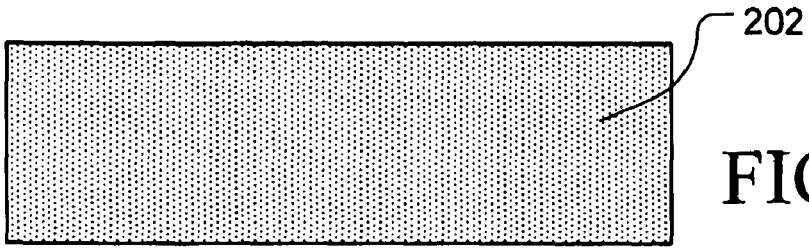
FIGS. 5A-C illustrate another embodiment of the invention.
Figure 5B:
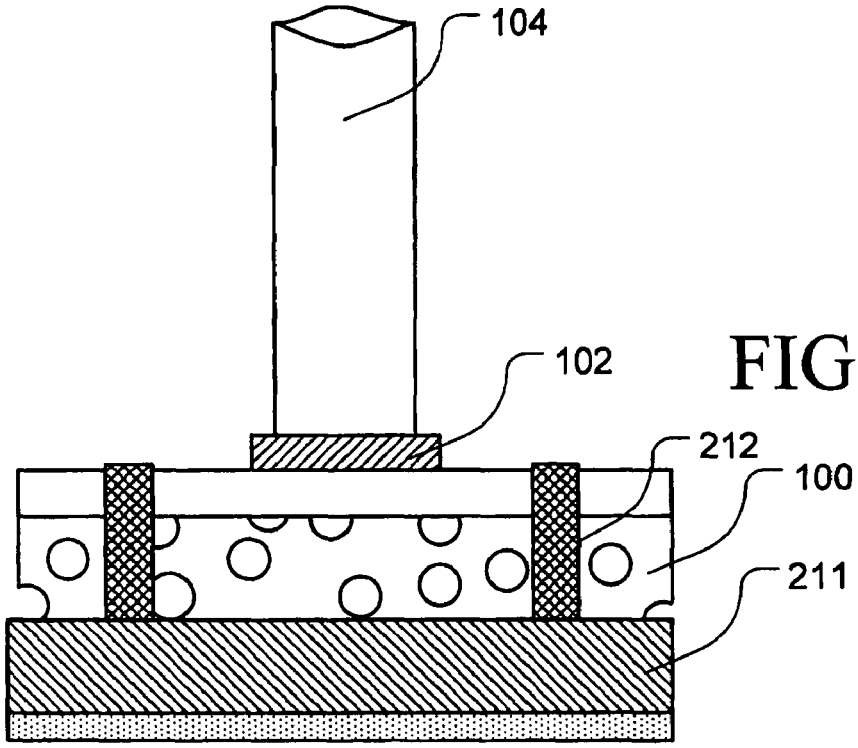
Figure 5C:
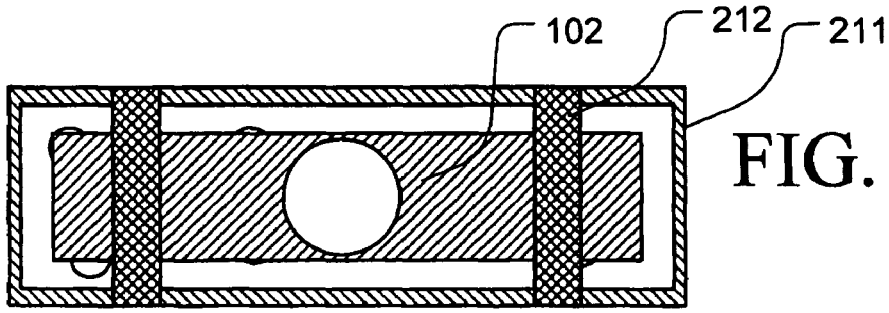

Another exemplary embodiment of the invention is illustrated in FIGS. 5A-C. As illustrated in FIG. 5A, the cleaning tool cover 200 includes a primary microfiber surface 202 that extends across the original cleaning surface of the cleaning tool 10. As illustrated in FIG. 5B, the peripheral portion of the primary microfiber surface may be secured to a reinforced material 211, which may be rigid or semi-rigid, that with the primary microfiber surface define a recess into which a portion of the head of the cleaning tool may be placed. As illustrated in FIG. 5C, the cleaning tool cover may include elastic straps 212 or other fasteners for securing the cover to the head of the cleaning tool.

Figure 6A:
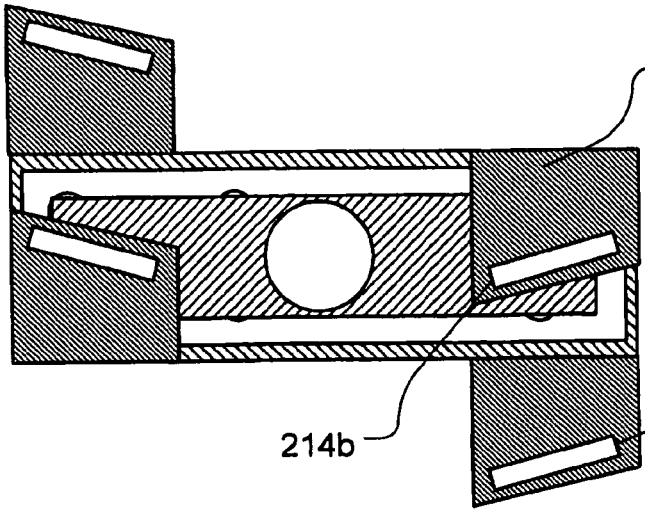
FIGS. 6A-C illustrate exemplary flap attachment configurations.
Figure 6B:
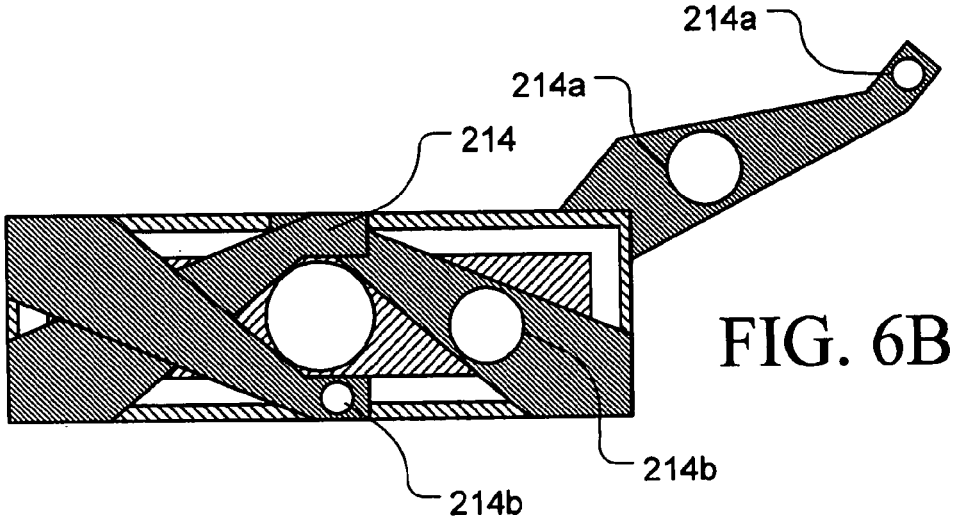
Figure 6C:
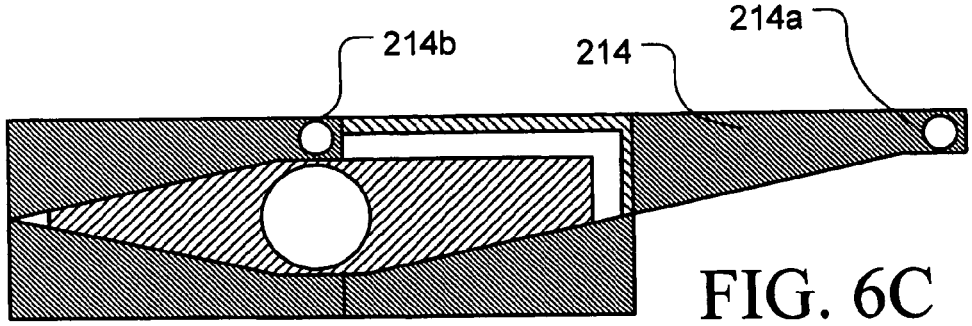

As illustrated in FIGS. 6A-C, the cleaning tool cover may be secured to the cleaning tool head using a series of flaps 214 that can be attached to each other or to attachment regions provided on the head of a cleaning tool specifically configured for use with a particular tool cover design. A more "universal" cleaning tool cover, however, will be configured for attachment to a range of cleaning tools. In addition to the "bonnet" configuration illustrated in FIGS. 3A-C, the cleaning tool cover may be provided with a series of flaps 214 that may be attached to each other in a variety of configurations including, for example, those illustrated in FIGS. 6A-C. The flaps may be provided with corresponding attachment regions 214*a*, 214*b* using snaps or hook-and-loop materials such as VELCRO to allow for both removable attachment and size adjustment to provide a secure attachment to a range of cleaning tool heads. The flaps themselves may be made from microfiber or one or more other fabrics and may incorporate both resilient and more dimensionally stable regions to increase the adjustability of the cleaning tool cover.

It should be understood that the afore-described is merely the preferred one of many possible embodiments of the invention, and that the scope of the invention should therefore only be limited according to the following claims.

What is claimed is:

1. A cleaning tool cover comprising:

a primary microfiber surface, a water repellant layer defining a backing of the entire primary microfiber surface; and an attachment structure arranged and configured for holding the primary microfiber surface against a primary contact surface of the cleaning tool such that when the primary microfiber surface is held by the attachment structure against the primary contact surface of the cleaning tool, the water repellant layer substantially prevents water that contacts the primary microfiber surface from contacting the primary contact surface of the cleaning tool and substantially prevents contaminants on the primary contact surface of the cleaning tool from reaching the primary microfiber surface.

2. A cleaning tool cover according to claim 1, wherein:

the attachment structure includes a microfiber skirt portion extending from the primary microfiber surface to define a recess and;

an elastic member attached to a peripheral region of the skirt portion to define an opening that may be temporarily expanded to provide an enlarged opening through which a portion of the cleaning tool may be inserted into the recess.

3. A cleaning tool cover according to claim 2, wherein:

the cleaning tool is a sponge mop and the portion of the cleaning tool inserted into the recess includes a mop head.

4. A cleaning tool cover according to claim 1, wherein:

the attachment structure includes a reinforced receiver portion extending from the primary microfiber surface to define a recess into which a portion of the cleaning tool may be inserted; and an elastic member attached to the reinforced receiver portion for removably securing a portion of the cleaning tool within the recess.

5. A cleaning tool cover according to claim 1, wherein:

the attachment structure includes a first pair of flaps extending from a first end of the primary microfiber surface;

a second pair of flaps extending from a second end of the primary microfiber surface;

each flap being configured for removable attachment to another flap for removably securing a portion of the cleaning tool against the primary microfiber surface.

6. A cleaning tool cover according to claim 1, in combination with the cleaning tool having the primary contact surface wherein the attachment structures holds the primary microfiber surface against a primary contact surface of the cleaning tool.

* * * * *